US006889951B1

(12) United States Patent
Shields

(10) Patent No.: US 6,889,951 B1
(45) Date of Patent: May 10, 2005

(54) DOCUMENT HOLDER

(76) Inventor: Michael Peter Shields, P.O. Box 91, Mammoth Lakes, CA (US) 93546

( * ) Notice: Subject to any disclaimer, the term of this patent is extended or adjusted under 35 U.S.C. 154(b) by 0 days.

(21) Appl. No.: 10/768,536

(22) Filed: Feb. 2, 2004

(51) Int. Cl.[7] ..... A47B 19/00; B42D 17/00

(52) U.S. Cl. ..... 248/441.1; 248/453; 281/45; D19/90

(58) Field of Search ..... 248/441.1, 453, 248/452, 450; 281/45; 40/658; D19/90, 75

(56) References Cited

U.S. PATENT DOCUMENTS

| | | | | | |
|---|---|---|---|---|---|
| 2,626,062 | A | * | 1/1953 | Manzella | 211/59.1 |
| 3,258,232 | A | | 6/1966 | Nestegard | |
| 3,779,504 | A | * | 12/1973 | Schwartz et al. | 248/441.1 |
| 4,075,773 | A | * | 2/1978 | Daster | 40/658 |
| 4,125,243 | A | | 11/1978 | Liptak | |
| 5,505,421 | A | | 4/1996 | Marthaler | |
| 5,842,721 | A | | 12/1998 | Kawabe | |
| 5,857,654 | A | * | 1/1999 | Berman | 248/441.1 |
| 5,864,977 | A | | 2/1999 | Alvern | |
| D418,166 | S | | 12/1999 | Dill | |
| 6,059,249 | A | * | 5/2000 | Scatterday | 248/450 |
| D426,853 | S | * | 6/2000 | Clubbe | D19/90 |
| 6,129,323 | A | * | 10/2000 | Mandokoro et al. | 248/453 |
| D460,295 | S | * | 7/2002 | Fissell et al. | D6/467 |
| 6,481,687 | B2 | * | 11/2002 | Najmi | 248/452 |
| D466,556 | S | * | 12/2002 | Rosado | D19/90 |
| D478,353 | S | * | 8/2003 | Huang | D19/75 |
| 6,676,100 | B2 | * | 1/2004 | Hsu | 248/452 |

* cited by examiner

*Primary Examiner*—Anita M. King
(74) *Attorney, Agent, or Firm*—David T. Bracken

(57) ABSTRACT

The present invention is a single or multiple sheet document holder with a base plate supporting three posts, each post having mounted at its top a cupola formed with an upwardly facing socket adapted to securely and easily rotatingly hold a metal ball. The document holder uses a support slot forming contact points for a paper sheet or sheets to be supported. The support slot receives one or more sheets for support via substantial lateral curvature up and down the page combined with substantial deviation from vertical support (the top of the sheets slant slightly back and away from the user).

15 Claims, 9 Drawing Sheets

DOCUMENT HOLDER

BACKGROUND OF THE INVENTION

The present invention relates to document holders that support documents for ease of access and review by a user.

Extensive use has been made of a certain aspect of paper sheets and similarly responsive sheet material in the art of making one or more of the sheets stand at a substantially more vertical than horizontal angle for viewing and/or ease of handling. That aspect is the tendency of such sheets to resist bending if sufficient vertical curvature is imposed on the sheet. Document holders are well known in the prior art making use of this feature.

U.S. Pat. No. 5,505,421 describes a copyholder for mounting on a surface having a base for mounting and pivotal paper holding means comprised of two opposed curved portions forming a paper-receiving channel. The curved portions have s-shapes. In this particular document holder, the sole support for the document is from a lowest edge of the sheet to a short distance up from that edge. This is a particular advantage since the lowest edge of a document typically has a substantial margin and lets the person viewing the document do so without having to hold it up in the air to get an angled view of it.

U.S. Pat. No. 5,842,721 describes a paper sheet holder with a base plate, a paper sheet guiding plate, which is arcuate as viewed in a top plan (upper direction), a permanent magnet fixed at a convex side surface of the paper sheet guiding plate, and a movable permanent magnet movably and magnetically attracted by the curved outer wall surface at the concave surface of the paper sheet guiding plate. The guiding plate is fixed in a slanted orientation above the base plate. A paper sheet holder includes a base plate, a paper sheet guiding plate made of non-magnetic material, a plurality of permanent magnets embedded in the paper sheet guiding plate while being spaced apart by a predetermined distance in a horizontal direction, and a plurality of movable permanent magnets spaced apart by a predetermined distance in a horizontal direction. The movable permanent magnets are magnetically attracted to both side surfaces or one side surface of the paper sheet guiding plate. The requirement of using aligned magnets for a document holder substantially increases its price where equivalent functions may be obtained using only a molded plastic device.

U.S. Pat. No. 4,125,243 describes a small sign holder with a flat base of resilient material and two projections. The first projection has a convex, sloped side surface, and the second projection has a corresponding concave, sloped side surface spaced from the convex side surface of the first projection. An arcuate wedge-shaped trough is formed between the side surfaces of the projections. The edge of a sign card or board is inserted in the trough and removably held upright thereby. The wedge shape of the trough and the resilient material of the base combine to firmly grip the edge of the sign card. This combination of two separated elements is a distinct disadvantage in that the elements must be particularly aligned and separated only within a certain range in order to obtain its stated benefits.

U.S. Pat. No. 5,864,977 describes a display apparatus for use with a fuel pump filler gun. The apparatus has a barrel, a head, and a handle, includes a clip. The clip has opposed retaining surfaces biased toward one another. The retaining surfaces are configured to grasp a display between the opposed retaining surfaces and hold the display spaced apart from the filler gun. The display apparatus further includes various techniques for attaching the clip to the filler gun or to a protective boot covering a portion of the filler gun. The display apparatus can provide an expanded display area beyond the limited area of the filler gun itself without interfering with the use of the filler gun during the fueling operation. This type of document holder demonstrates a spring force method of holding a document without substantial vertical bending of the sheet to be displayed.

U.S. Pat. No. 3,258,232 describes a formed support that causes a single sheet to be vertically curved by using two separated and slotted arms forming a substantial obtuse angle with respect to each other. This two-point contact method of document support is relatively unreliable for non-rigid sheets as relaxation of the sheet vertical curvature can occur unless the arm thickness is substantially increased.

U.S. Pat. No. D418,166 shows a particularly popular document holder sold under the commercial name "Page Up". Two slightly inclined continuous front and back surfaces connect with a floor section that has a higher elevation at the ends of the slot than at the middle part of that floor section. This configuration lets the user insert a single page that leans slightly away from the user. The slight declination of the paper (which is typically of about 30 pound weight or less) combined with a lateral curvature, i.e., a slight U-shape when viewed from above, causes results in a good view of the paper with stable support. However, in the commercial embodiment, a substantial weight is contained in the device of this patent to support the weight of multiple sheets of paper. A sand or fluidized solid material must be contained in the device to prevent its falling over when the paper support slot holds up to about the maximum of about 20 sheets of paper.

The art of document holding is necessarily connected with aesthetics and design. The pleasant appearance of a document holder, which can be produced at low cost, makes it more economically viable as a product that a user will want to place on their workspace. The above and other prior art devices have not adequately combined the functional and pleasing aspects of document holders for one or more documents. There is a need for a document holder that can hold one or more sheets that presents to the user a pleasant and interesting design.

SUMMARY OF THE INVENTION

The present invention is a single or multiple sheet document holder with a base plate supporting three posts, each post having mounted at its top a cupola formed with an upwardly facing socket adapted to securely and easily rotatingly hold a metal ball. The document holder uses a support slot forming contact points for a paper sheet or sheets to be supported. The support slot receives one or more sheets for support via substantial lateral curvature up and down the page combined with substantial deviation from vertical support (the top of the sheets slant slightly back and away from the user).

The support slot comprises a front support and back support. The front support comprises two contact points for supported sheets, one contact point at a metal ball face and another contact point at an undercut (notched) base of the post supporting that metal ball. The back support provides four contact points for lateral support for a supported sheet. Two back posts are aligned to form a part of a back support such that supported documents are laterally supported on a back side of the sheet substantially only from the metal balls supported from the posts and at two other points or surfaces discontinuous from the metal ball contacts. Extending forward and in a convex curvature from each of the two back posts as a further part of the back support is a wedge shaped flange adapted to cause an inserted and supported sheet to contact it at substantially one vertical line or more preferably at a single point.

The support slot portion comprising the front support comprises a single front post having a notch at its base, the front post supporting a cupola piece rotatingly holding a metal ball in its socket, which metal ball is one of the two points of contact for a front side of a supported sheet in the support slot. In front of the front post is a display flange adapted to receive and present to a user's view text, graphic devices and/or present other informational or pleasant designs therefrom, whereby ends of the display flange extend towards ends of the wedge shaped flanges of the back support to optionally define right and left ends of the support slot. The right and left edges of the display flange optionally form locations for two additional contact points of the front side of a supported sheet in the support slot. The second essential contact point for the front side of a supported sheet is at the lowest notched corner of the front post next to the base plate. The ability of a supported sheet to move into the notch, which undercuts the metal ball to about beneath its center, permits the entire sheet to slant away from the user so that the sheet is more easily viewed and is supported.

The choice of spacing and geometry of the aspects of the support slot make it possible to support up to 50 or more sheets of paper within the support slot, a dramatic improvement over the commercial device of U.S. Pat. No. D488,166. As the number of sheets of paper in the support slot increases to a obvious maximum, the only visible effect noticeable by the user is that the sheets are not slanted as much as a single sheet. This is due to the tendency of users to insert a stack of sheets aligned with each other, forming a thick lowest stack edge that must be received into the notched base of the first post. The exclusion effect of the thick stack in the notch of the first post necessarily causes the stack of papers to be forced into a more vertical angle than if only a single sheet were inserted.

Another embodiment of the present invention is a first support slot formed as above from a single front post backed by a first set two flanged back posts, whereby a second set of flanged support posts are aligned with and spaced apart from the first set. The opposing surfaces of the first and second sets of posts form a second support slot for a number of paper sheets that may be supported in the first support slot. Additional sets of pairs of flanged posts can be added in back of a more forwardly spaced set of flanged posts to thereby provide additional support slots ad infinitum.

BRIEF DESCRIPTION OF THE DRAWINGS

FIG. 11 is a side view of a leading piece.

FIGS. 12 and 13 are respectively side and top views of back pieces.

DETAILED DESCRIPTION OF THE INVENTION

Figure 1:
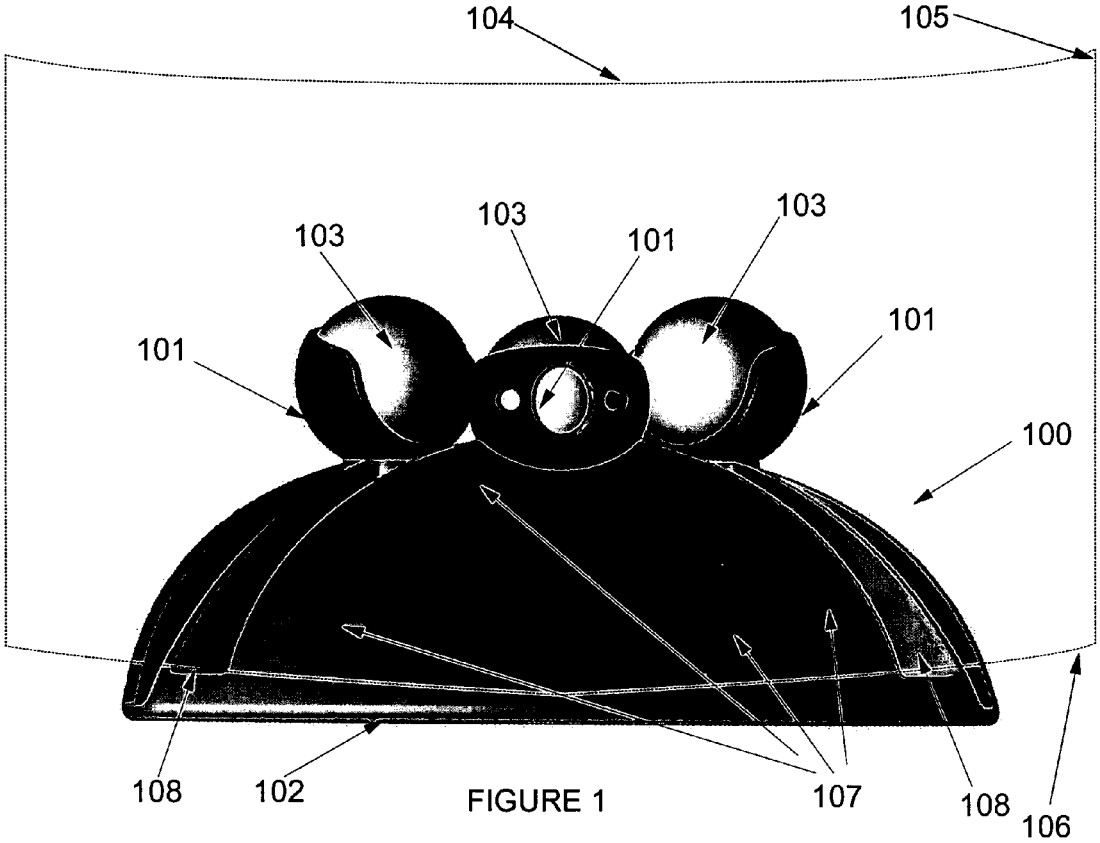
FIGS. 1–5 are respectively front; side, rear, bottom and top views of the invention document holder.

The invention is now discussed with reference to the figures. FIGS. 1–5 show the holder 100 comprises a base plate 102 supporting several structures arising from it. One of the novel aspects of holder 100 is the ability to form the holder, except for cupola pieces 101 and metal balls 103, from a single injection molding step. The cupola pieces 101 and metal balls 103 are formed in separate steps and later pressed into place in the appropriate locations as described below.

Generally, rear cover 111, posts 117 and 118, wedge shaped flanges 109, display flange 107 and its associated support rib 114 extend up from a base plate 102 that comprises a bottom plate 112, mold openings 113 and 116, and a front edge that is the bottom edge of display flange 107. Cupola pieces 101 are inserted into posts 117 and 118 so that an upward presented socket receives metal balls 103. That is substantially the entire form of one preferred embodiment of the holder. It is critical to the operation of one embodiment of the invention that the metal balls provide mass necessary for effective functioning of the invention device. A drawback of the commercial device of U.S. Pat. No. D488,166 is that it requires a polymer case that seals the support mass inside a shell so that such mass needed to prevent the device from falling over doesn't spill. In the present invention, a very inexpensive polymer frame comprising a base plate, single front cupola supported by a base-notched post (hereafter referred to as a front support post), and two similar support posts with flanges extending from them weighs as little as about 25 grams or about half an ounce. Into the cupolas are inserted metal balls of about 15–20 grams. The resulting assembly at about over 90 grams, more preferably at above 100 grams, supports over 50 pages with a base to top of ball distance of only about 1.5 inches and a second height from the bottom of the support slot to the highest contact face of the metal ball at about one inch. The second height may be reduced to about ¾ of an inch.

Figure 21:
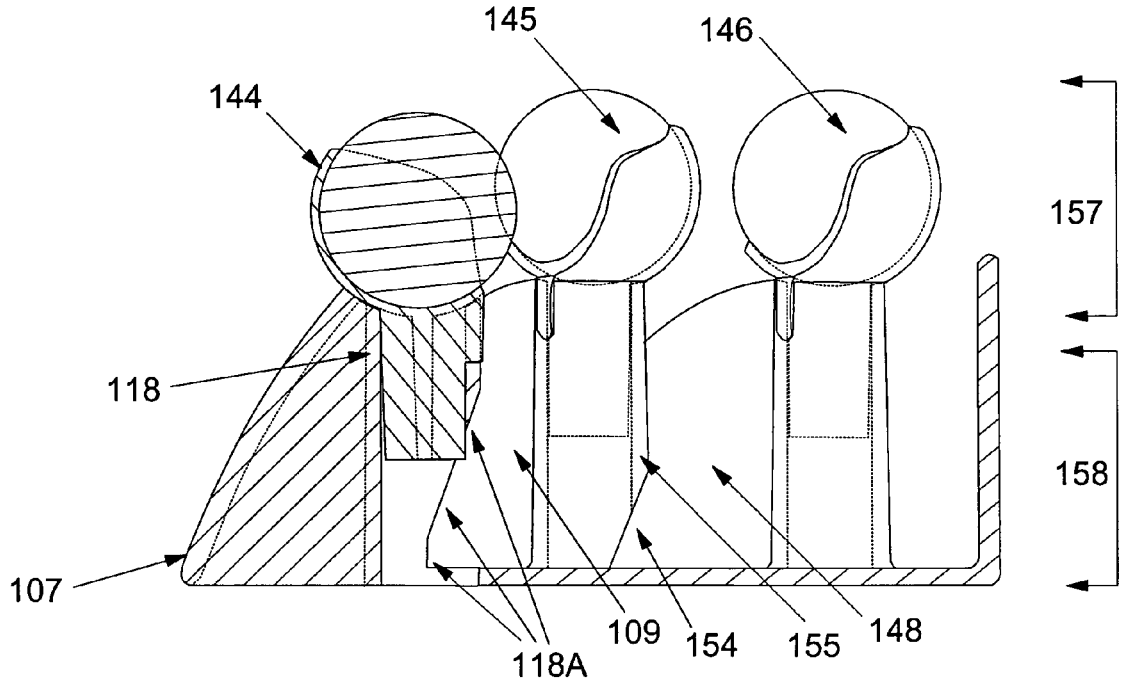
FIG. 21 shows a side, cut-away view of the device of FIG. 14 where a notch at the base of a more forward support post may be seen.

FIG. 21 shows that the invention has an upper weighted zone 157 and a lower support zone 158. In a preferred embodiment, the upper weighted zone comprises the top ends three separated posts, each post having a relatively heavily weighted piece such as the metal balls shown. The three weighted pieces are at least about over one half, and more preferably over about two thirds, of the total weight of the combined weight of the upper weighted zone 157 and the lower support zone 158. The prior art teaches extensively and universally to locate the greatest part of the weight of the small document holder as low as possible. The present invention departs from that teaching and produces an unexpected effect. The unexpected effect is that a low center of gravity is not always needed for a small document holder.

The weighted pieces of the present document holder are located on separated posts that effectively deliver a their gravitational force to the support base of the piece at a critical separation. The particular separation and elevation of the weighted pieces at the top of their posts endow the invention document holder with surprising resistance to toppling over even when supporting about 50 or more pages of paper.

In one embodiment of the invention, the weighted pieces of the upper weighted zone 157 can equal over three fourths of the combined weight of the upper weighted zone 157 and the lower support zone 158. That delivered force generated from a relatively high position at a substantially topmost point of the paper contact with the document holder where the separated posts.

It is intended that the portion of holder 100 in FIG. 1 comprising the lateral support structures for supported sheets, i.e., the support posts with cupola pieces/metal balls, the wedge shaped flanges, and only optionally right and left edges of the display flange, may be duplicated on a rearward extension of the base plate 102 to form a second holder structure similar in function to that shown in FIGS. 1–10. It is another embodiment of this second holder structure that the base plate extension formed to support that structure be raised above the level of bottom plate 112 in a step fashion so that tops of supported sheets in the second holder structure are seen above the supported sheets in the structure of the first such holder shown in FIGS. 1–10. The stepwise extensions of the base plate with additional holder structures may be continued to several such structures as may be practical for the user to reach the backward extending sequence of invention holders.

From the description above of a minimum structure needed to accomplish the invention objects, the skilled person will recognize therefrom that the minimum structure may be applied on a contiguous base plate structure with other office desktop structures and devices such as pencil and pen holders and other types of document holders.

The simple assembly of the device of FIGS. 1–10 disguises the substantial benefit to be obtained from use of the invention device. FIG. 1 shows the outline of a supported sheet 104, intended to be slanted into the plane of the drawing sheet. The preferred holder 100 comprises a raised portion of base plate 102 at the lowest part of the right and left ends of support slot 108 to deflect upward the supported sheet 104, as in FIG. 1. The right and left base plate ends of the support slot are with reference to the base plate 102 to notch 118A transition level more clearly seen in FIG. 7.

Again with reference to FIG. 1, front support ball 103A and back support balls 103B are respectively mounted in the socket(s) of front cupola piece 101A and back cupola pieces 101B, which socket portion(s) may comprise decorative openings seen thereon. Piece 101A and pieces 101B are respectively insertably secured in front support post 118 and back support posts 117. Balls 103 are preferably secured in the sockets of pieces 101 so that they cannot be removed without substantial effort, and more preferably are rotatable in the sockets of pieces 101. The rotatability of balls 103 enhances the ease of insertion and removal of sheets from support slot 108.

Figure 2:
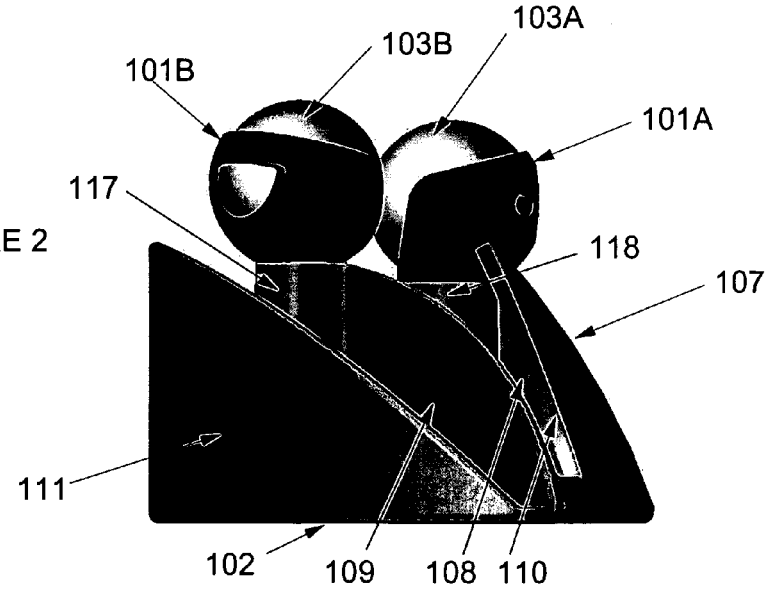
Figure 3:
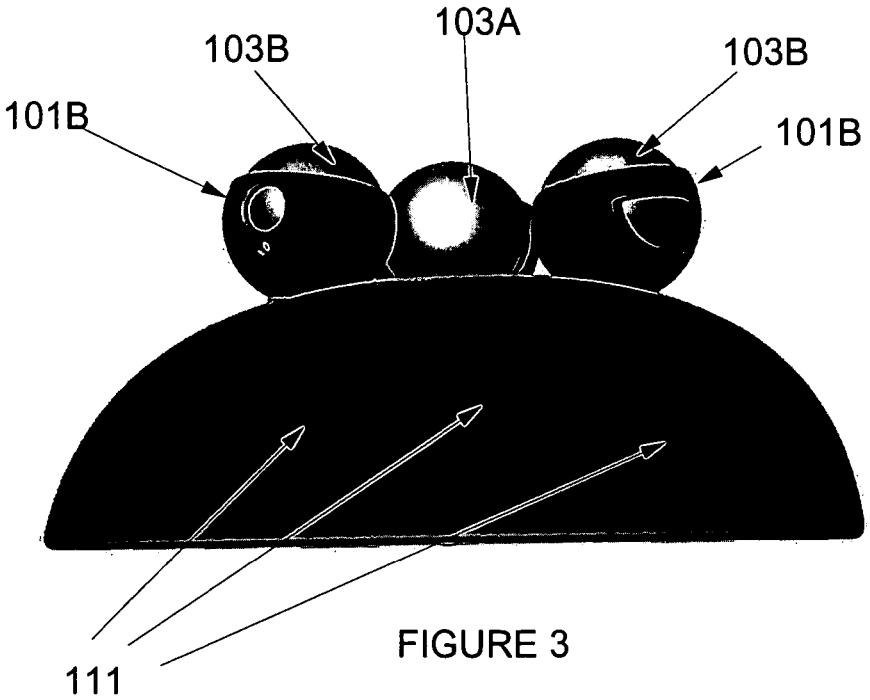

FIG. 2 more clearly shows edge 110 at the left end of display flange 107, whereby edge 110 may optionally but does not preferably deflect a front side of a support sheet 104. Wedge shaped flange 109 extends from approximately the entire length of back support post 117 arcuately to the front of holder 100 to a location defining an end of the back support side of support slot 108. FIG. 3 shows decorative openings in the sockets of pieces 101B, which openings assist in reducing friction needed to cause rotation of balls 103B when supported sheets are moved against them.

Figure 4:
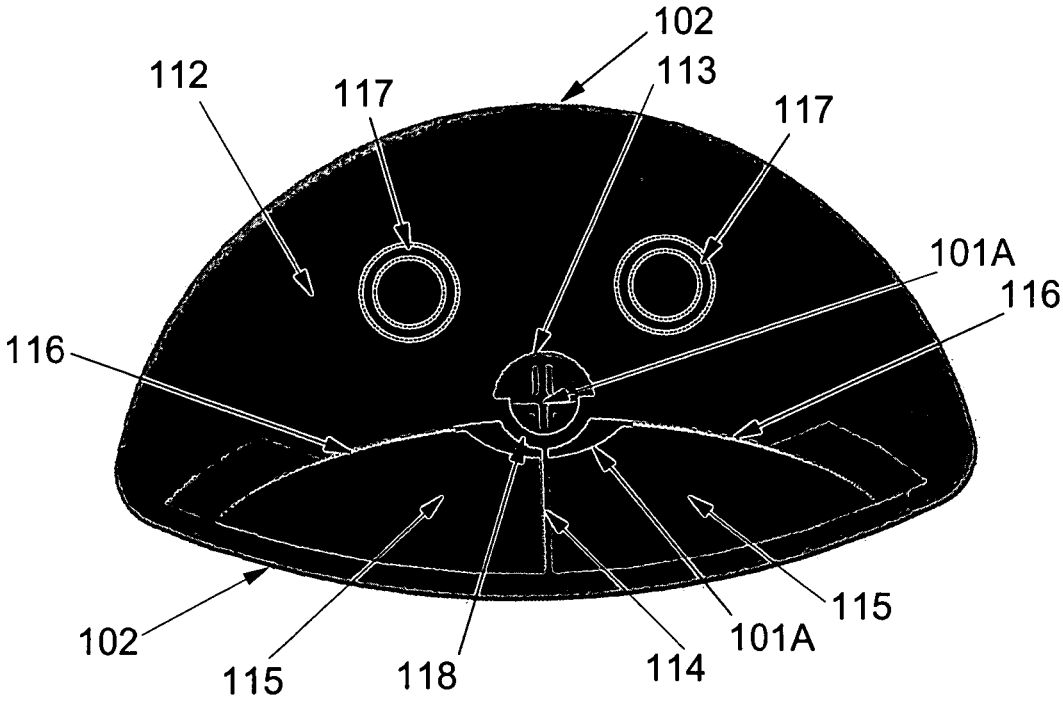

FIG. 4 shows mold hole openings 113 (for producing notch 118A) and 116 (for producing the raised aspect of the flange 107, the backside 115 is seen divided by support rib 114, which extends from backside 115 to generally the vertical forward length of front support post 118 to provide exceptional structural support to the display flange 107.

Figure 5:
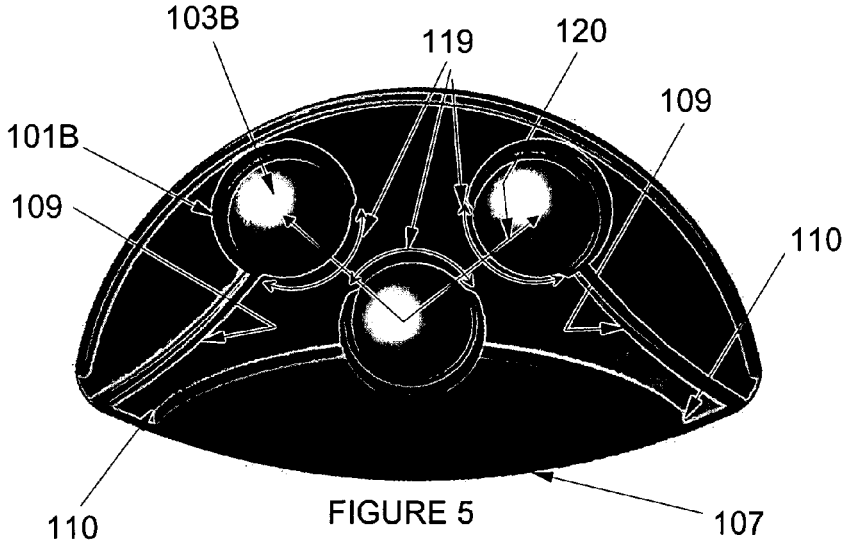

FIG. 5 shows that in top view the socket mounted balls 103 have opposing faces 119 without interference of portions of pieces 101. The V-shape and distancing 120 of the axes of balls 103, pieces 101, and posts 117 and 118 provide a unique orientation when combined with the flanges 109 and 107, raised slot ends for base plate 102 and notch 118 to produce the invention effects on supported sheets.

Figure 6:
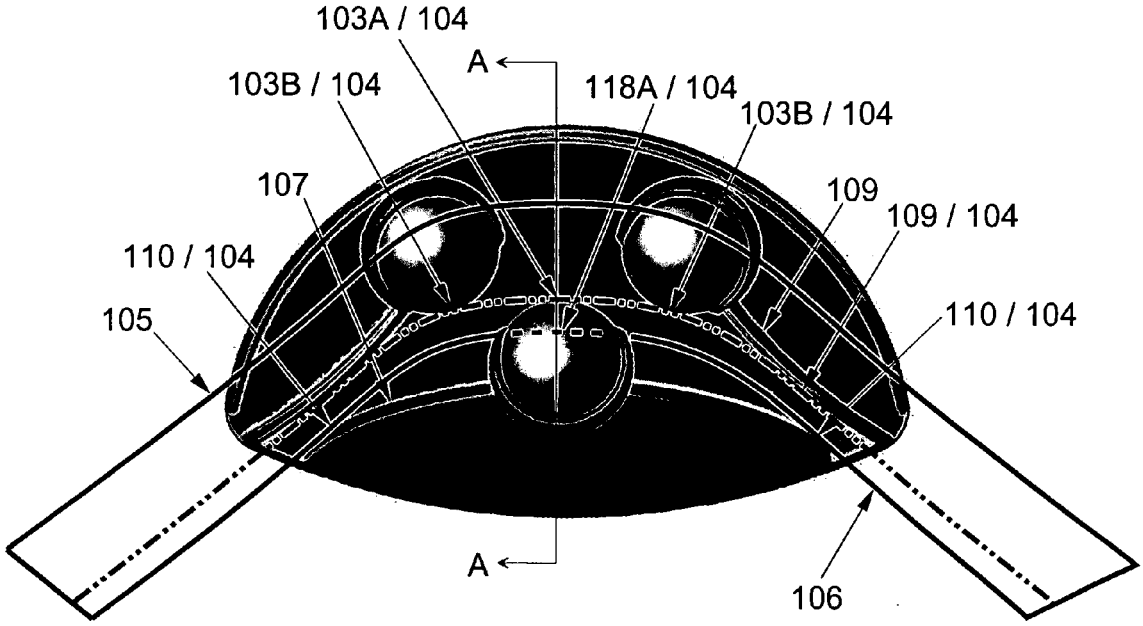
FIG. 6 is the view of FIG. 5 showing the position of a supported sheet in the support slot.

FIG. 6 shows a top view of the device of FIG. 5 with an inserted sheet 104 and also showing critical lateral support contact points. The back support lateral contact points are at the two ball to sheet interfaces 103B/104 and the two flange to sheet interfaces 109/104, all generally along the broken line showing approximate elevation of those contacts. The preferred front support contact points are at the ball to sheet interface 103A/104 and notch base to sheet interface 118A/104 (more clearly shown in FIG. 7). The bottom edge 106 of sheet 104 is shown as it would generally lie adjacent to the top of base plate 102.

Figure 7:
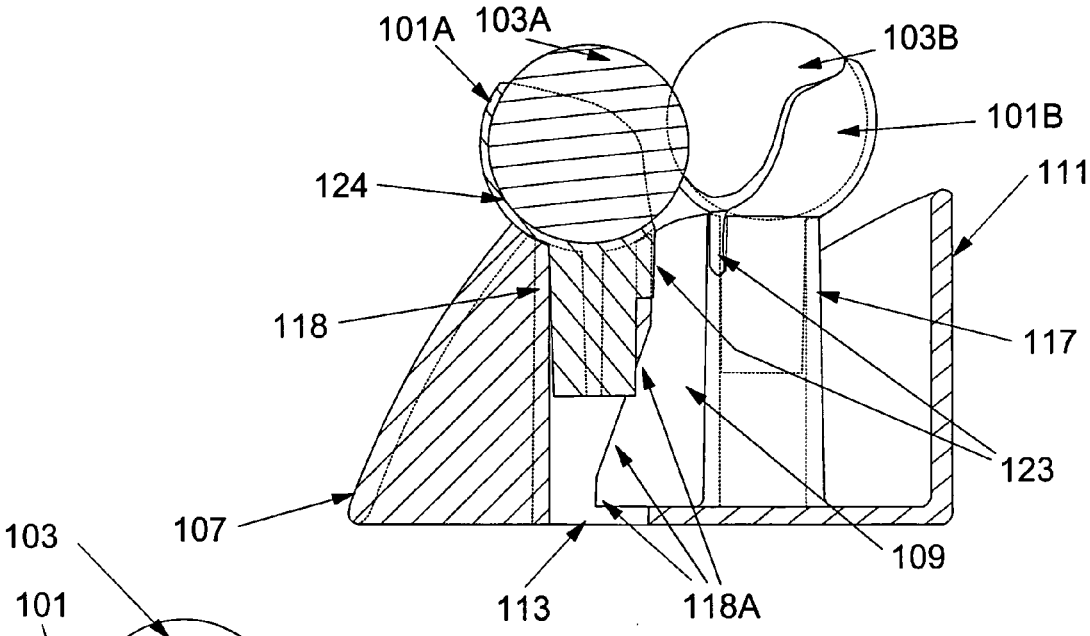
FIG. 7 is section AA of FIG. 6.
Figure 8:
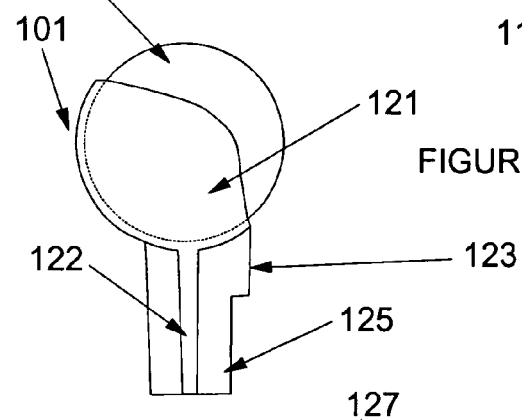
FIG. 8 is a side view of the invention cupola piece shown in section AA of FIG. 7.
Figure 9:
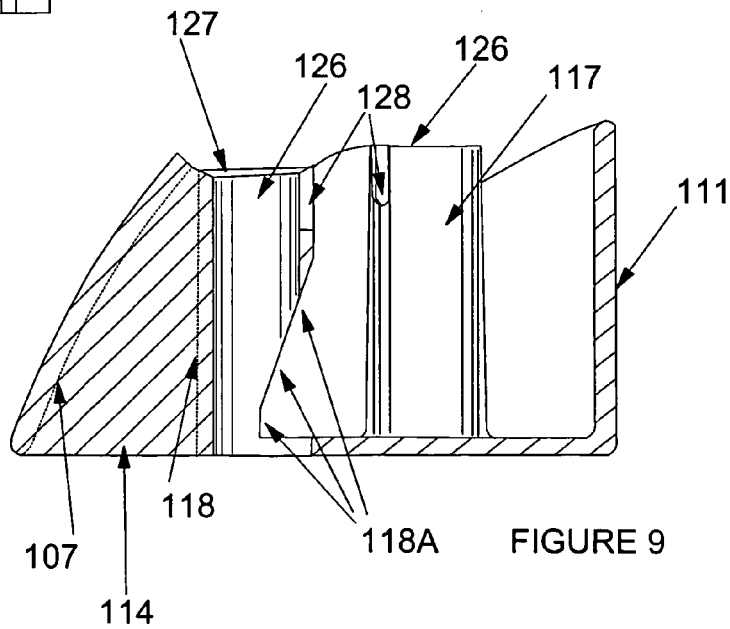
FIG. 9 is the view of FIG. 7 without the cupola pieces.

FIGS. 7 and 9 show that posts 117 and 118 have vertical bores 126 into which are inserted the generally X-cross section support extensions 122 of cupola pieces 101 (as in FIG. 8). To properly radially orient the pieces 101 in the support posts to maintain their opposing faces 119, slots 128 in the posts 117 and 118 and lugs 123 (as in FIG. 8) extending from extension 122 are brought matingly together, as shown in FIG. 7. FIGS. 7 and 9 show the critical relationship of notch 118A to the front support post 118. The lowest most point of notch 118A provides for reception of the lower edge 106 of a supported sheet 104, as shown in FIG. 10 at point 118A/104.

Figure 10:
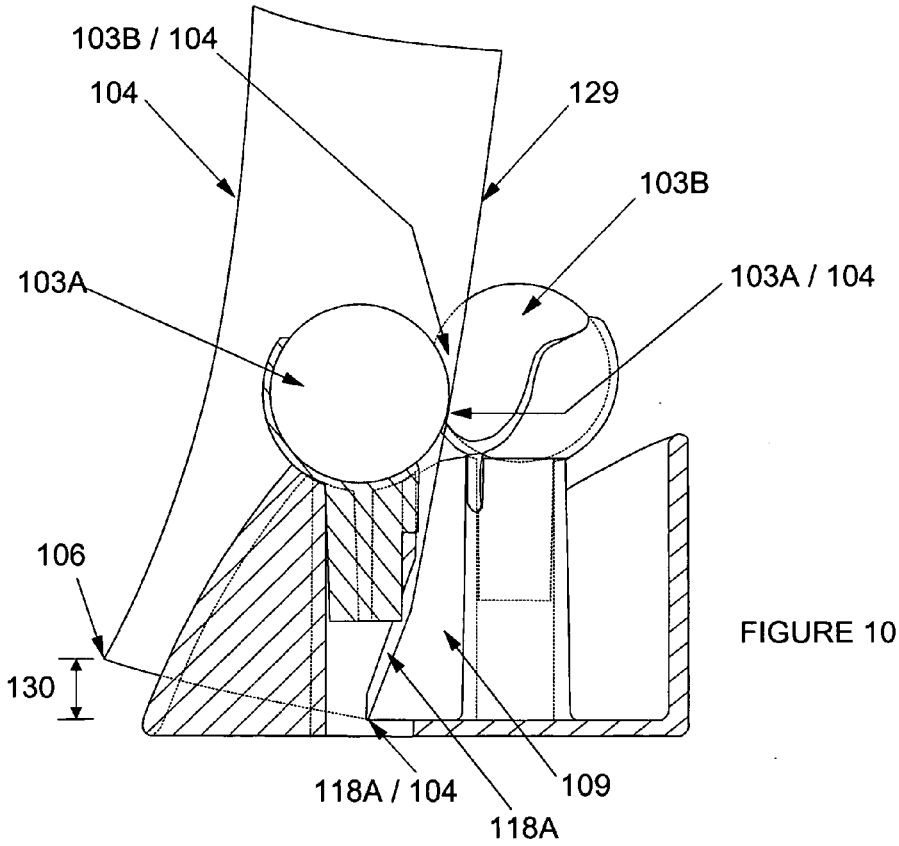
FIG. 10 is the view of FIG. 7 showing the position of a supported sheet in the support slot.

FIG. 10 shows that with respect to point 118A/104, the lower edge 106 of 104 extending outside of slot 108 is raised to an elevation 130. Sheet 104 is divided along a vertical centerline 129 along the section AA of FIG. 6 to more effectively show the operation of the invention device.

Holder 110 in FIGS. 1–10 is about 2 inches long from right to left sides along base plate 102 as shown in FIG. 1. The other angles and orientations of the Figures are specifically proportional to that measurement in a preferred example. Distancing 120 as in FIG. 5 is approximately 80–100 degrees in a preferred embodiment. The distance between the axes of posts 117 and 118 is about 0.4 to 0.6 inches, and more preferably about 0.5 inches, such that respectively the diameters of balls 103 is about from ¼ to ½ inches, and more preferably about ⅜ inches. A most preferred shortest distance between faces 119 of balls 103 is about from 1/16 inches to ¼ inches, with a more preferred distance of about ⅛ inches.

Figure 11:
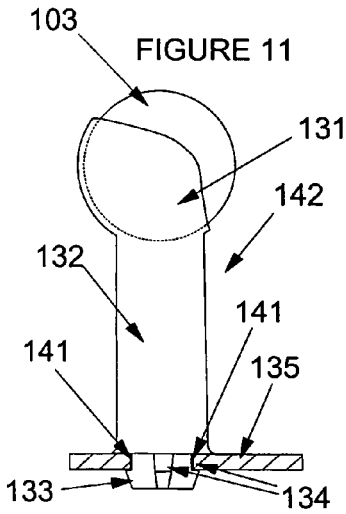
FIGS. 11–13 are pieces attachable to a support surface adapted to be arranged therefrom to accomplish substantially the same function as the device of FIGS. 5 and 6.
Figure 12:
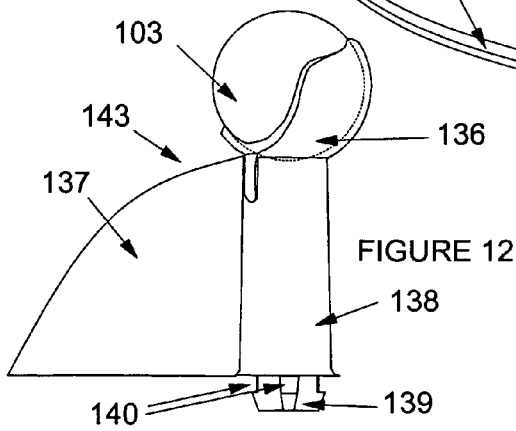
Figure 13:
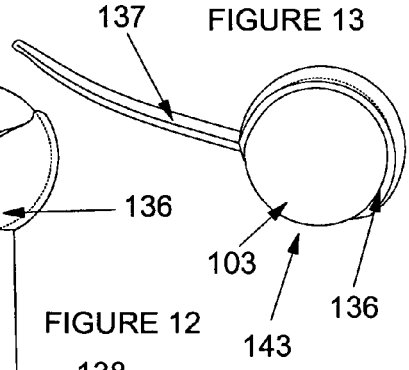

The present invention also comprises an embodiment of substantially a surface with attachment means for each of three pieces, the combination thereby performing most of the functions of the previously described invention document holder. The pieces each comprise at least latching means, engageable to the attachment means, at the base of a post section, where the post section is capped with the invention cupola and ball. Two of such pieces further comprise the invention flanges extending from the post pieces. The present embodiment requires insertion of the latch means into the engagement means for each piece resulting in a configuration substantially the same as shown in FIGS. 5 and 6 without the frontal piece 107. The present embodiment pieces are shown in FIGS. 11–13. FIG. 11 is a side view of a piece 142 intended to be inserted in a hole 141 of planar support 135 (shown broken away at hole 141 and in side view) so that latch part 133's notches 134 securely engage the sides of hole 141 causing piece 142 to stand erect as to support 135. Piece 142 substantially replaces the assembly of parts 101A/103A/118 in FIG. 7 as to the function of document support. FIGS. 12 and 13 show piece 143 that is also intended to be inserted in a hole 141 of planar support 135 (not shown in those FIGS. 12 and 13, but similarly to those of FIG. 12) so that latch part 139's notches 140 securely engage the sides of hole 141 causing piece 142 to stand erect as to support 135. Piece 143 substantially replaces the assembly of parts 101B/103B/117 in FIG. 7 as to the function of document support. Piece 142 comprises a post 132 rising form latch 133 to support cupola 131 which holds ball 103. Piece 143 comprises a post 138 rising form latch 139 to support cupola 136 which holds ball 103. Flange 137 is supported from the side of post 138. Two pieces 143 are arranged with one piece 142 on a surface 135 with three appropriately spaced holes 141 to form thereby an assembly with substantially the same function as the device shown in FIGS. 5 and 6. The present embodiment enables location of the invention pieces 142/143 to secure such pieces to virtually any convenient surface. It will be apparent to one skilled in the art that the method of effectively attaching pieces 142 and 143 to a surface may be made in a wide number of ways to accomplish the objects of this embodiment, i.e., mating pieces of hook and loop material on the bottom of the pieces and the surface 135, male/female threaded holes on the bottom of the pieces and the surface 135, and other latching, interlocking or connective means. Surface 135 can be a tabletop, a computer keyboard, a desktop telephone, an desktop organizer, or any other such available support surface, whether or not the surface is flat, curved or discontinuous, the only requirement that document support is convenient or needed therefrom so that a substantially vertical placement of the pieces is obtained in the relationship described for the device of FIGS. 5 and 6.

FIGS. 14–21 show a multi-slot embodiment 150 of the invention. For this embodiment, a support post comprises a post secured to a base plate, the post extending to a cupola securing a metal ball, as in FIG. 21 that shows single from support post 144, first slot support posts 145, and second slot support posts 146. Support posts 144 and 145 further comprise respectively-notches 118A and 154 (as in post 155). The present embodiment adds a row of aligned support posts 146 on a rearward-extension of base plat to the embodiment of FIGS. 1–5, thereby forming another slot 147 with ends of the slot vertically higher than a middle portion, similar to the construction of slot 108. As seen in FIGS. 14–17, flanges 148 (substantially the same as flanges 109) extend from the post part of support posts 146 to effectively duplicate the function of the flanges 109 as to slot 108. The function of an undercut notch 118 in post 117 as to a sheet of inserted paper is essentially duplicated by providing notches 154 in the rearward facing base post parts of support posts 145, as in FIG. 21.

Figure 18:
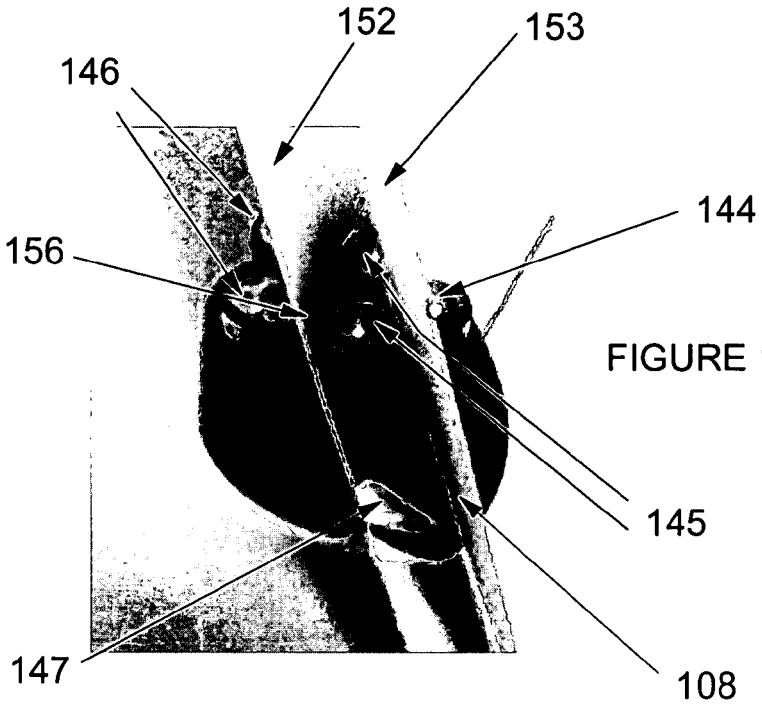
FIGS. 18, 19 and 20 are side, front and front views of the device of FIG. 14 holding respectively two sheets, one sheet and two sheets of paper.
Figure 19:
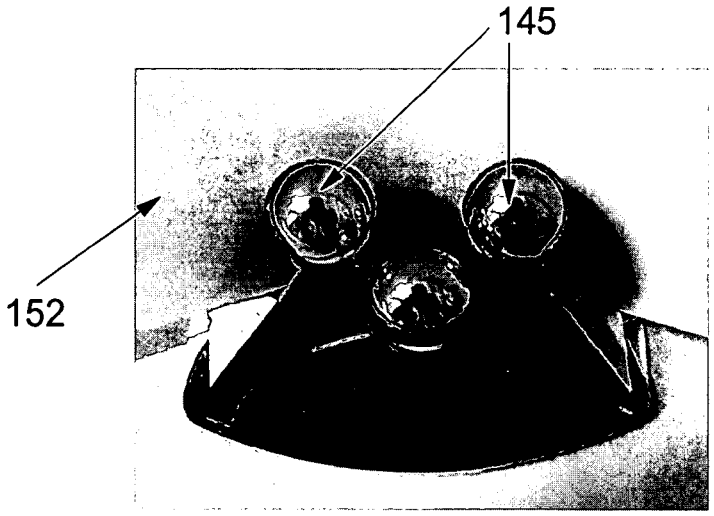
Figure 20:
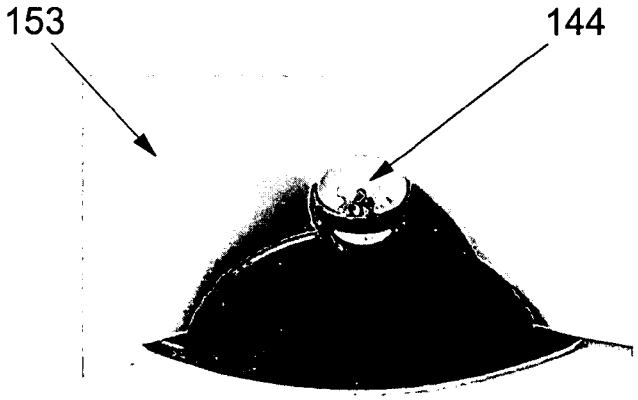

FIG. 18 shows support slots 108 and 147 supporting respectively sheets 153 and 152. It has been found that slot 147 thereby provided with notches 154 eliminates a requirement for sheet 152 contact at interface 156 (as in FIG. 18) with the back side of the metal balls of support posts 145 until more than about 10–20 sheets are inserted in slot 147. FIG. 19 shows a front view of the device of FIG. 14 with sheet 153 removed. FIG. 20 shows shows a front view of the device of FIG. 14 with sheet 153 inserted.

Figure 14:
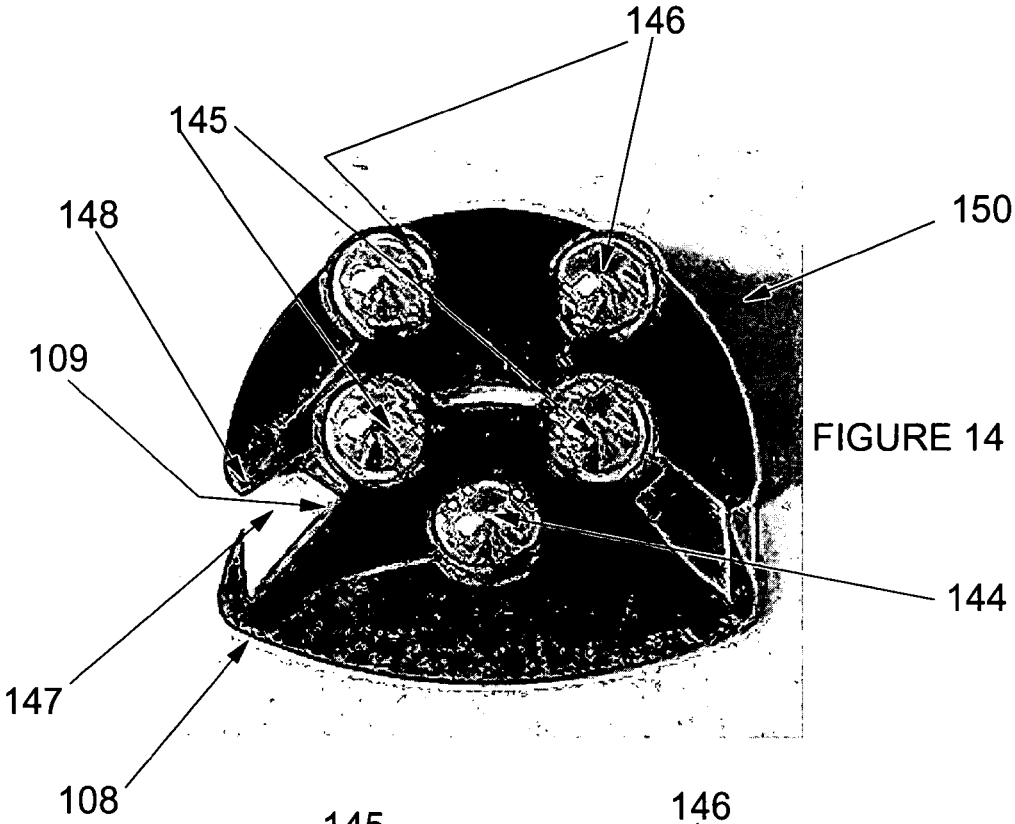
FIGS. 14, 15 and 16 are top, side perspective, and rear perspective views of an alternate embodiment of the device of FIGS. 1–5.
Figure 15:
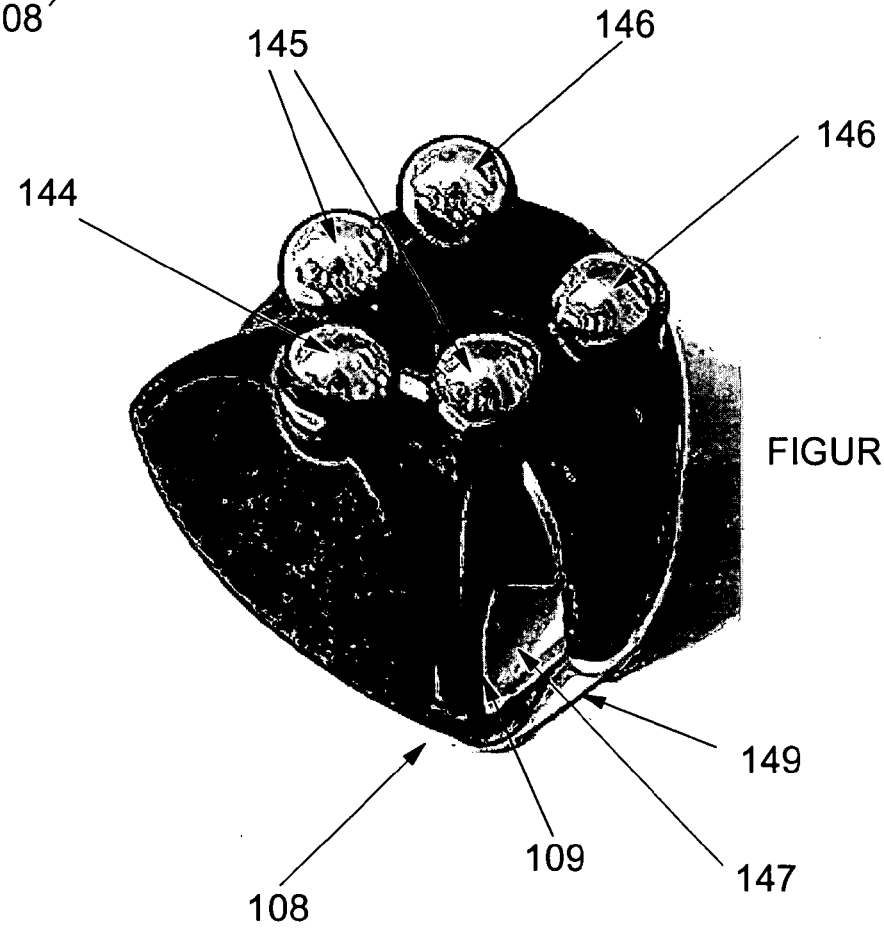
Figure 16:
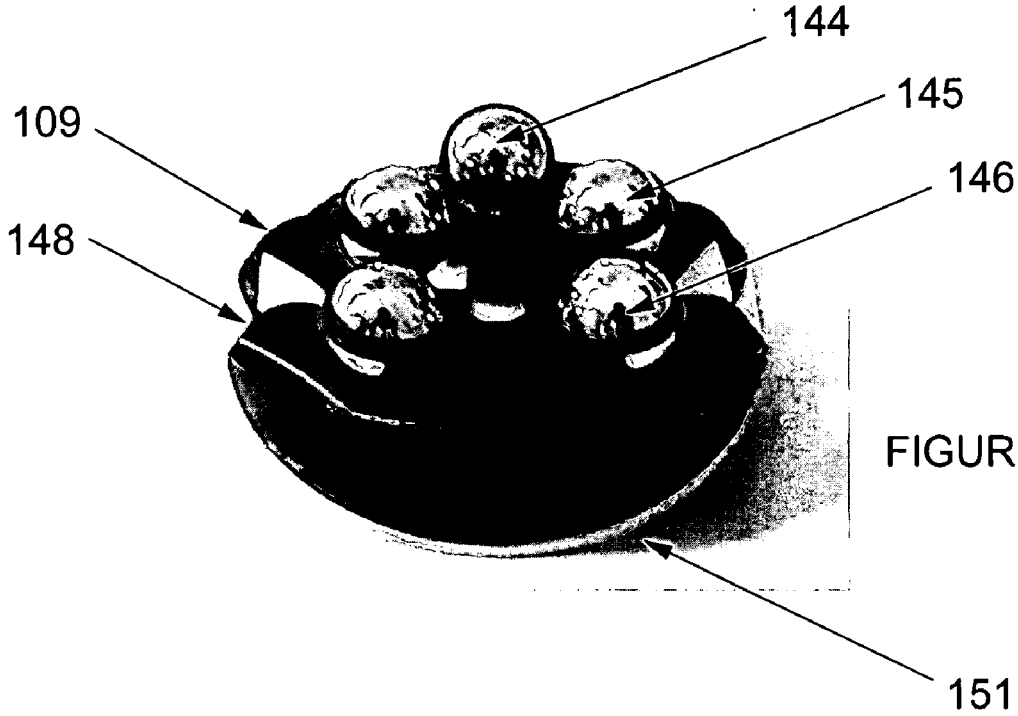
Figure 17:
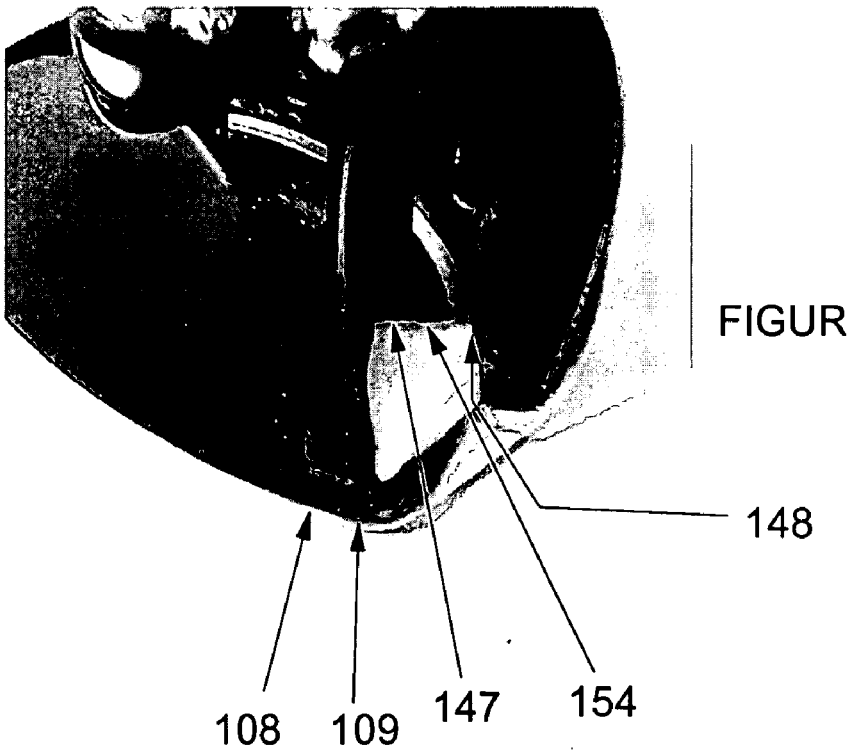
FIG. 17 is a close-up side perspective view of the device of FIG. 14 whereby support slots and flanges are more clearly seen.

The device of FIG. 14 is an extension of the device of FIGS. 1–5. Additional extensions to form additional paper support slots may be made in substantially any number.

In a preferred embodiment, the weighted pieces each weigh about two ounces or less. In another preferred embodiment, the entire weight of the document holder is about 90 grams or less. In another preferred embodiment, a planar base plate has a side to side length of about five inches or less and a front to back width of about four inches or less and is supported on a substantially flat and horizontal surface.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A document holder adapted to support sheets of paper at a slight angle away from vertical through contact only at a lower part of those sheets comprising:

(a) a planar base plate with a side to side length of about five inches or less and a front to back width of about four inches or less and is supported on a substantially flat and horizontal surface;

(b) each of three posts extending rigidly up from the base plate so that the posts are essentially normal to the horizontal surface;

(c) each post terminating in a holding means securely holding a weighted piece at about the same vertical distance from the horizontal surface, whereby a portion of the holder below the weighted pieces defines a lower support zone and the portion of the holder above the lowest part of the weighted pieces defines an upper weighted zone;

(d) two of the posts are spaced apart to define ends of a base of an equilateral triangle in a top view with the third of the posts spaced apart from the others to form a top vertex of the equilateral triangle, whereby a paper retaining slot is formed between the base ends posts and the top vertex post and is adapted to cause a bottom edge of a cover sheet to abut a lowest part of the top vertex post and the lower part of inserted and supported sheets behind a cover sheet are slightly curved when the sheets are supported at topmost parts of the posts; and (e) the weight of the upper weighted zone is above about half of the weight of the total weight of the holder.

2. The holder of claim 1 wherein the weighted pieces each weigh about two ounces or less.

3. The holder of claim 2 wherein weighted pieces are made of metal.

4. The holder of claim 3 wherein substantially all the rest of the holder is made of plastic with a density substantially less than that of the weighted pieces.

5. The holder of claim 1 wherein the weighted pieces have spherical surfaces which contact the sheets for support.

6. The holder of claim 5 wherein the weighted pieces are metal balls of approximately the same size.

7. The holder of claim 1 wherein the total weight of the holder is about and above 90 grams.

8. The holder of claim 1 wherein the weighted piece supported from the top vertex post has a substantially greater lateral radius than the top vertex post.

9. The holder of claim 8 wherein a lowermost part of the top vertex post is cut away so that a bottom edge of the cover sheet reaches to about a line extending vertically down from the center of gravity of weighted piece supported from the top vertex post.

10. The holder of claim 1 wherein the holding means are substantially cup shaped and expose a spherical surface of the weighted pieces for contact with supported sheets.

11. The holder of claim 10 wherein the weighted pieces are chrome plated metal balls.

12. A document holder adapted to support two or more sets of sheets of paper apart from each other an at a slight angle away from vertical through contact only at a lower part of each set of sheets comprising:

(a) a planar base plate supported on a substantially flat and horizontal surface;

(b) three or a higher odd number posts extending rigidly up from the base plate so that the posts are essentially normal to the horizontal surface;

(c) each post terminating in a holding means securely holding a weighted piece at about the same vertical distance from the horizontal surface, whereby a portion of the holder below the weighted pieces defines a lower support zone and the portion of the holder above the lowest part of the weighted pieces defines an upper weighted zone;

(d) two first posts are spaced apart to define ends of a base of an equilateral triangle in a top view with a third post spaced forward and apart from the others to form a top vertex of the equilateral triangle, whereby a paper retaining slot is formed between the base ends posts and the top vertex post and is adapted to cause a bottom edge of a cover sheet of a first set of sheets to abut a lowest part of the top vertex post and the lower part of inserted and supported sheets behind a cover sheet are slightly curved when the sheets are supported at topmost parts of the posts; and (e) one or more pairs of posts spaced apart from each other rearward from the base end posts to define one or more additional paper retaining slots and adapted to cause a bottom edge of a cover sheet of a second or higher set of sheets to abut a lowest part of the two posts forward from a more rearward set of posts and the lower part of inserted and supported sheets behind the second or higher set of sheets are slightly curved and inclined rearward when the sheets are supported at topmost parts of the rearward posts.

13. The holder of claim 12 wherein the weight of the upper weighted zone is above about half of the weight of the total weight of the holder.

14. The holder of claim 12 wherein the holding means are substantially cup shaped and expose a spherical surface of the weighted pieces for contact with supported sheets.

15. The holder of claim 12 wherein the weighted pieces have spherical surfaces which contact the sheets for support.

* * * * *